US006492959B1

(12) United States Patent
Heatherwick et al.

(10) Patent No.: US 6,492,959 B1
(45) Date of Patent: Dec. 10, 2002

(54) STACKED ARRAY ANTENNA SYSTEM

(75) Inventors: Alan E. Heatherwick, Frankfort; Edward L. Ostertag, Manhattan; Myron D. Fanton, Tinley Park; Kerry D. Scharp, Clifton; Walter J. Mamak, Lansing, all of IL (US)

(73) Assignee: Andrew Corporation, Orland Park, IL (US)

( * ) Notice: Subject to any disclaimer, the term of this patent is extended or adjusted under 35 U.S.C. 154(b) by 2 days.

(21) Appl. No.: 09/692,533

(22) Filed: Oct. 19, 2000

Related U.S. Application Data

(60) Provisional application No. 60/161,197, filed on Oct. 22, 1999.

(51) Int. Cl.[7] ..... H01Q 1/12
(52) U.S. Cl. ..... 343/890; 343/891
(58) Field of Search ..... 343/890, 891, 343/874, 767, 770, 731, 737; 52/40, 292

(56) References Cited

U.S. PATENT DOCUMENTS

| | | | | | |
|---|---|---|---|---|---|
| 2,945,231 | A | * | 7/1960 | Scheldorf | 343/890 |
| 4,141,014 | A | | 2/1979 | Sletten | 343/768 |
| 4,670,760 | A | | 6/1987 | Biby | 343/832 |
| 5,264,862 | A | | 11/1993 | Kumpfbeck | 343/853 |
| 5,954,305 | A | * | 9/1999 | Calabro | 248/219.4 |
| 6,088,002 | A | * | 7/2000 | Johnson et al. | 343/878 |
| 6,115,004 | A | * | 9/2000 | McGinnis | 343/890 |
| 6,133,890 | A | * | 10/2000 | Damiani | 343/890 |

* cited by examiner

*Primary Examiner*—Tan Ho
(74) *Attorney, Agent, or Firm*—Jenkens & Gilchrist

(57) ABSTRACT

A stacked array antenna system is presented having one or more antenna(s) as part of the supporting structure. This allows more than a single omni-directional antenna to be used with a minimum amount of azimuth pattern degradation. At least one antenna is actually part of the structure. By placing the antenna(s) in the structure, the antenna structure becomes a structural platform for one or more other antenna(s).

28 Claims, 13 Drawing Sheets

STACKED ARRAY ANTENNA SYSTEM

CROSS-REFERENCE TO RELATED APPLICATION

This invention claims priority to U.S. patent application Ser. No. 60/161,197, filed Oct. 22, 1999 and entitled "Stacked Array Antenna System."

BACKGROUND OF THE INVENTION

The invention is related generally to improvements in broadcast transmitting antennas and more particularly to a novel type of stacker approach for accommodating two or more antennas on the same tower structure without the desired directional characteristics of the antennas being significantly degraded by scattering effects.

Broadcast transmitting antennas are usually array type antennas. The onset of DTV (digital television) has brought the need for additional tower space. For omni-directional coverage, the only solution usually is a top-mount antenna since omnidirectional antennas at other locations will exhibit azimuth patterns which are degraded by the scattering effects of other elements of the tower structure. Normally only one top-mount antenna can be considered per tower, since other antennas at the top of the tower will cause such scattering effects.

With this in mind, there is a need to have more than one omni-directional coverage antenna per tower. Currently, the only solution was to use an offset stack or stack two antennas and run the feeder for the upper antenna through the lower antenna aperture ("centerfed stack"). Both of these solutions are accepted, but can cause undesired azimuth coverage patterns, i.e., significantly different from the desired omni-directional pattern.

SUMMARY OF THE INVENTION

A general object of this invention is to provide improved azimuth coverage by incorporating the antenna design into the support structure.

In accordance with the invention, an antenna and tower structure mountable to a tower top or building top, comprises an elongated tower having a generally polygonal cross-sectional configuration and constructed having at least three spaced apart upright members defining said polygonal cross-sectional configuration and a plurality of cross members interconnecting said upright members, and at least one of said upright members of said elongated tower comprising an elongated antenna.

DETAILED DESCRIPTION OF THE ILLUSTRATED EMBODIMENT

Figure 1:
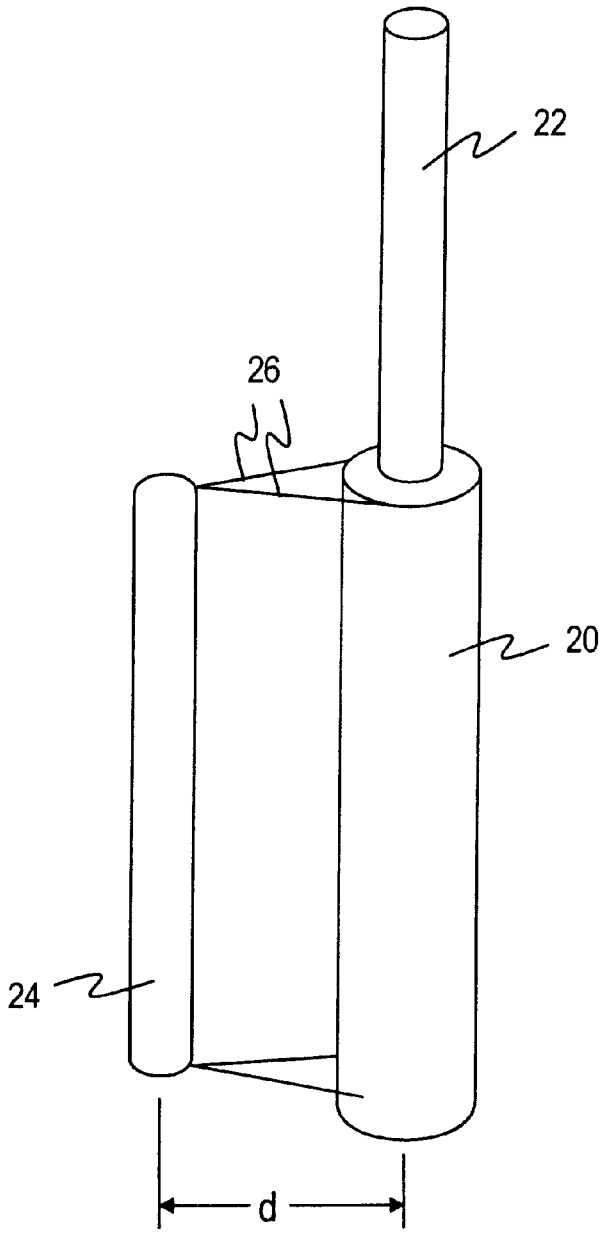
FIG. 1 PRIOR ART
FIG. 1 is a simplified showing of an offset stack type of antenna system of the prior art.
Figure 4:
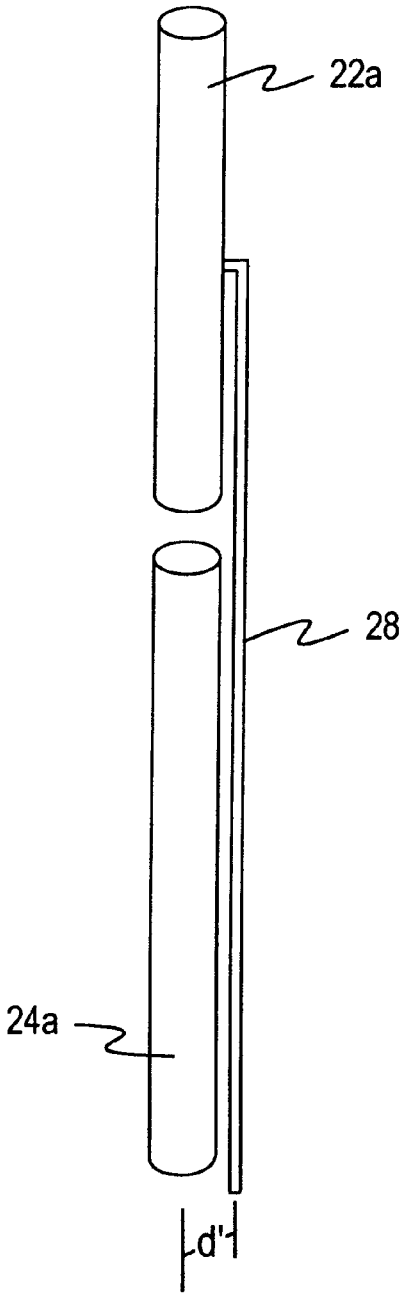
FIG. 4 PRIOR ART
FIG. 4 is a simplified showing of a centerfed stack type of antenna system of the prior art.

Referring initially to FIGS. 1 and 4, prior art arrangements for mounting more than one omnidirectional antenna on a tower have included either an offset stack type of arrangement as shown in FIG. 1 or a centerfed stack arrangement as shown generally in FIG. 4. In the offset stack of FIG. 1, a tower top structure such as a cylindrical pylon 20 may be utilized to mount an upper or top antenna 22. The second or lower antenna 24 is coupled to the pylon 20 by a plurality of outwardly extending struts or other suitable supporting structure 26. Typically, the distance (d) from the center of the lower antenna 24 to the center of the pylon 20 is on the order of 36 to 40 inches. In FIG. 1, the antennas 22 and 24 are omnidirectional antennas having a travelling wave type of structure. That is, the antennas 22 and 24 typically comprise cylindrical or tubular pipes which may be on the order of 40 to 60 feet in length and from 8 to 10 inches diameter. The pipes are usually longitudinally slotted, having longitudinal arrays of slots spaced apart by approximately one wavelength of the center frequency of the channel which the antenna is intended to transmit. For omnidirectional coverage, the arrays of longitudinally spaced slots are typically repeated at substantially 90° or 120° intervals about the periphery of the tube or pipe forming the antenna body.

Figure 2:
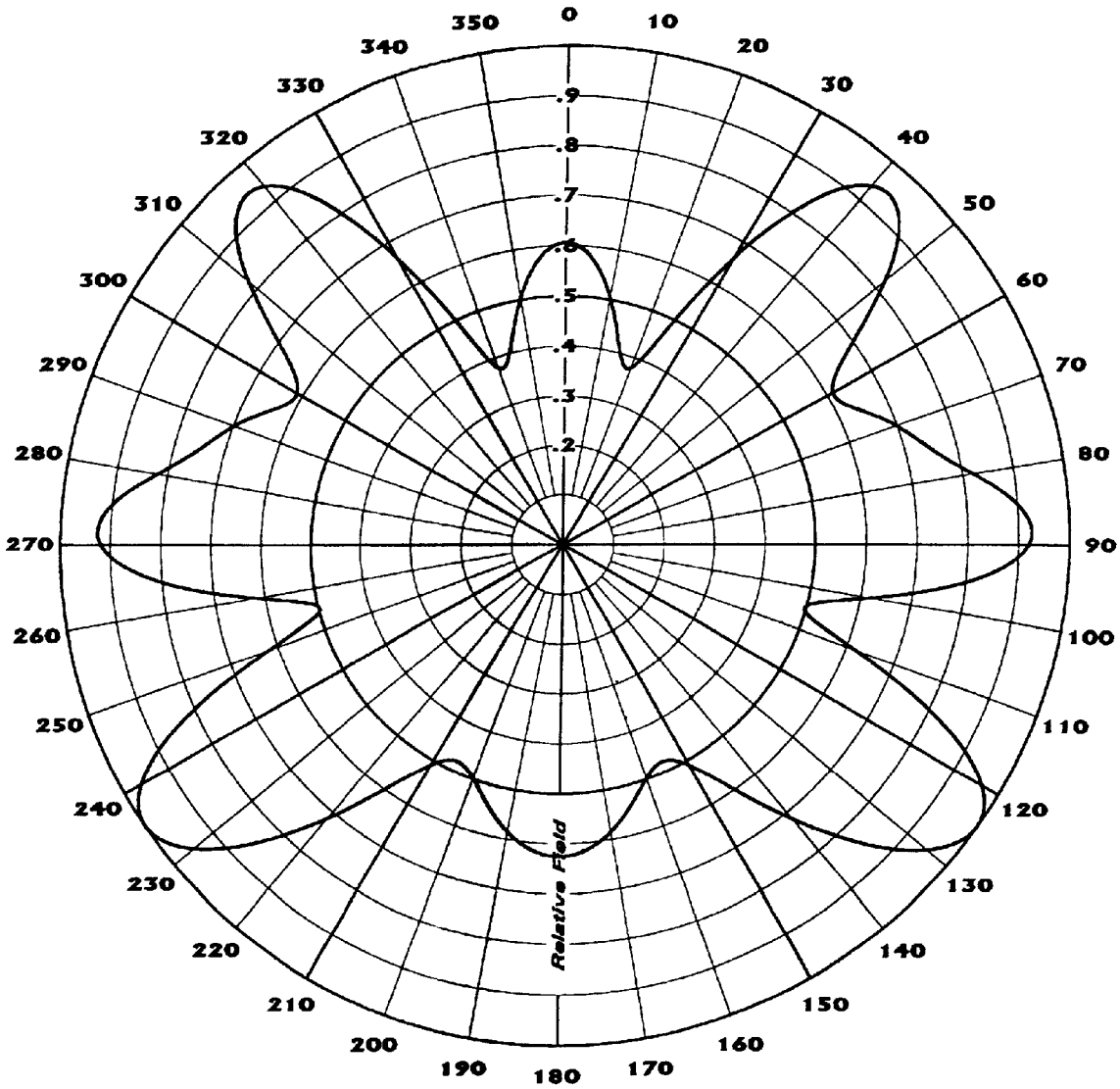
FIG. 2 PRIOR ART
FIG. 2 is an azimuth pattern for the offset antenna of the system of FIG. 1.

Referring now also to FIG. 2, in the example shown, the lower antenna 24 of FIG. 1 is 8.6 in diameter and is configured for transmitting UHF channel 35 and the spacing d is 36 inches. The azimuth pattern shown in FIG. 2 exhibits significant degradation as the result of scattering effects caused by the close proximity of the relatively large pylon 20 to the lower antenna 24. Similarly, considerable degradation is seen in the azimuth pattern of FIG. 3, which is for the antenna 24 configured for transmitting UHF channel 35 at a distance d of about 40 inches from the pylon 20. In this regard, it should be appreciated that the azimuth patterns show the relative field, that is, relative to a value of 1.0 which would be the relative field strength for an ideal omnidirectional antenna about a 360° azimuth coverage.

Figure 5:
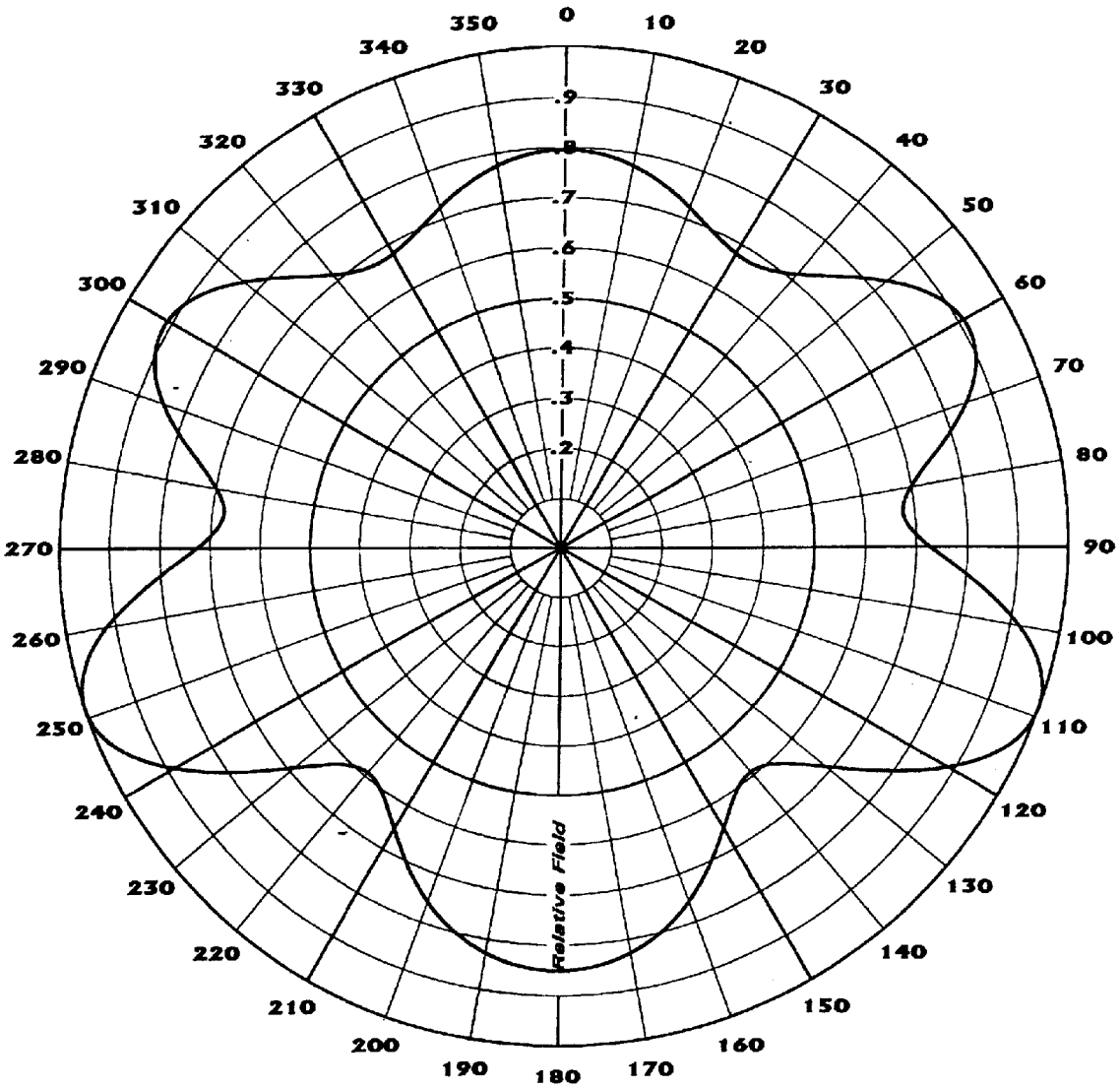
FIG. 5 PRIOR ART
FIG. 5 is an azimuth pattern for the lower antenna of FIG. 4.

Referring now to FIG. 4, a second prior art arrangement is a centerfed stack. In FIG. 4, respective supporting structures have not been illustrated. However, in the typical case, the lower antenna 24*a* is supported on the tower top or other supporting structure and the upper antenna 22*a* is supported directly or indirectly by the lower antenna 24*a*. That is, some intermediate support structure may be interposed between the top end of the lower antenna and the base of the upper antenna 22*a*. However, a feeder or feedline 28 for the upper antenna must extend vertically past the lower antenna 24*a*. In the example shown, the upper and lower antenna 22*a* and 24*a* may be substantially identical to the upper and lower antennas 22, 24 shown and described above with reference to FIG. 1. Typically, the feeder is approximately a 6 inch diameter member, and in the specific example shown in FIG. 4 has a 6.2 inch diameter. Accordingly, the azimuth pattern of FIG. 5 is produced by the lower antenna 24*a* of 8.6 in diameter, configured for transmitting channel 35. The considerable degradation seen in the azimuth pattern of FIG. 5 results largely from the scattering effects caused by the presence of the feeder 28 in relatively close proximity to the lower antenna 24*a*. In the example shown in FIG. 4, this distance d is approximately 21 inches center-to-center.

Figure 6:
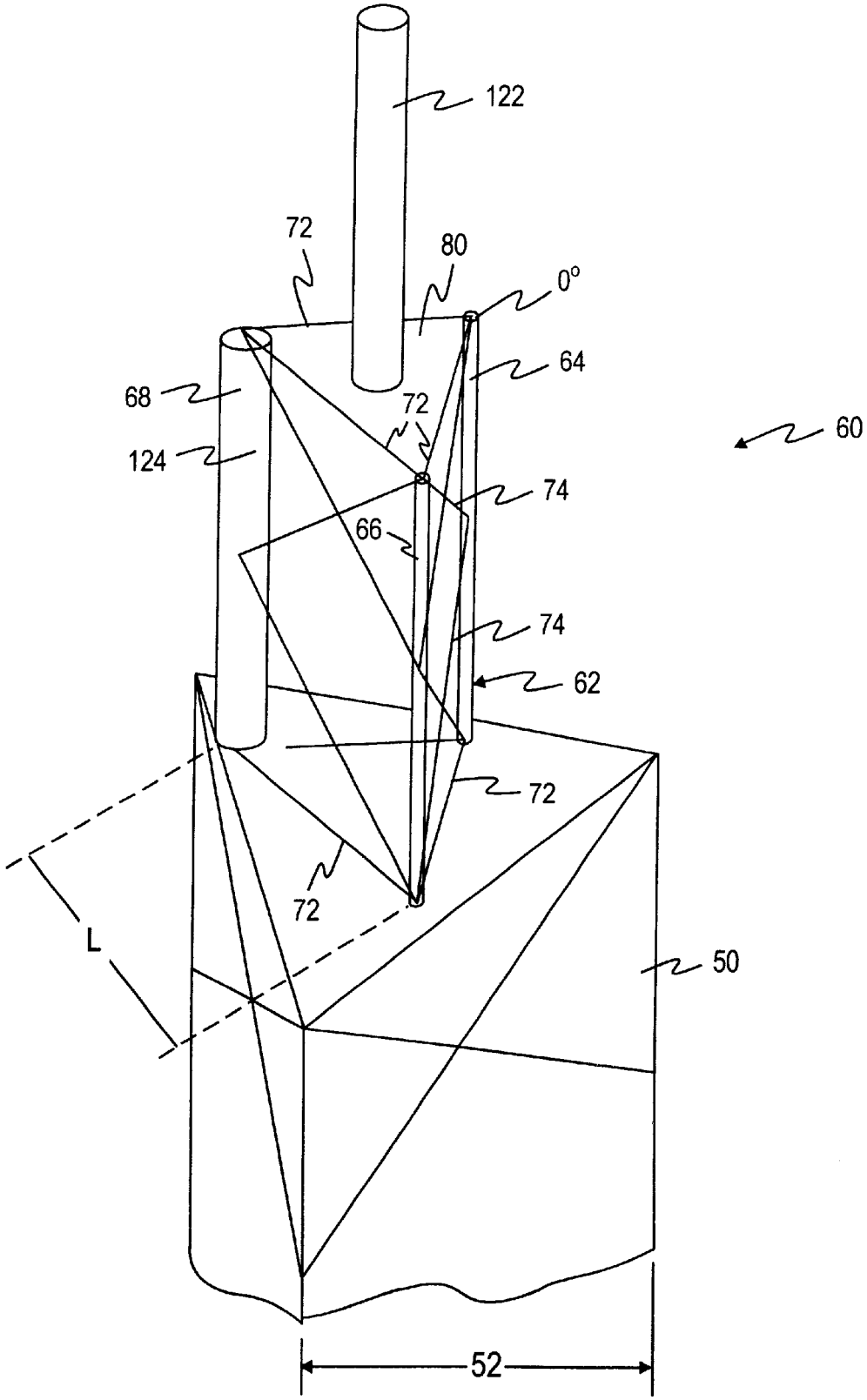
FIG. 6 is a somewhat simplified showing of a first type of stacked antenna structure in accordance with the invention.

Referring now to FIG. 6, one form of a stacked antenna structure in accordance with the invention is shown. The structure may be mounted to a typical tower 50, having a 12 foot tower face 52. That is, the tower 50 may be constructed of a number of structural members to form a triangular configuration which has 12 foot wide faces, as indicated by the reference numeral 52. However, the antenna structure in accordance with the invention, which is designated in FIG. 6 by the reference numeral 60 may also be mounted atop a tower of a different design, or atop a building or other structure without departing from the invention. The antenna structure 60 includes a tower or structural portion 62 which is constructed of three elongated upright members 64, 66 and 68 which are spaced apart in a triangular configuration to define a triangular cross-section for the tower structure 62. In the illustrated embodiment, the triangle defined by the uprights is equilateral in form. Additional uprights may be used if desired to form a different polygonal cross-sectional shape, such as a square or rectangle. However, with more uprights, more scattering effects can be expected.

Cross-support members 72 or plates may be utilized to interconnect the upright members at least at their top and bottom ends. Additionally, diagonal bracing 74 may be utilized as desired to complete the structure of the tower member 62. However, the number of cross-support members and diagonal braces should usually be minimized so as to minimize scattering effects. Mounted atop the tower 62 is an upper antenna 122 which in the illustrated embodiment is an omnidirectional travelling wave-type of antenna of the type generally described above with reference to FIG. 1. The antenna 122 may be from 40 to 60 feet in length and be an 8 to 10 inch diameter slotted "pipe," as described above.

Figure 7:
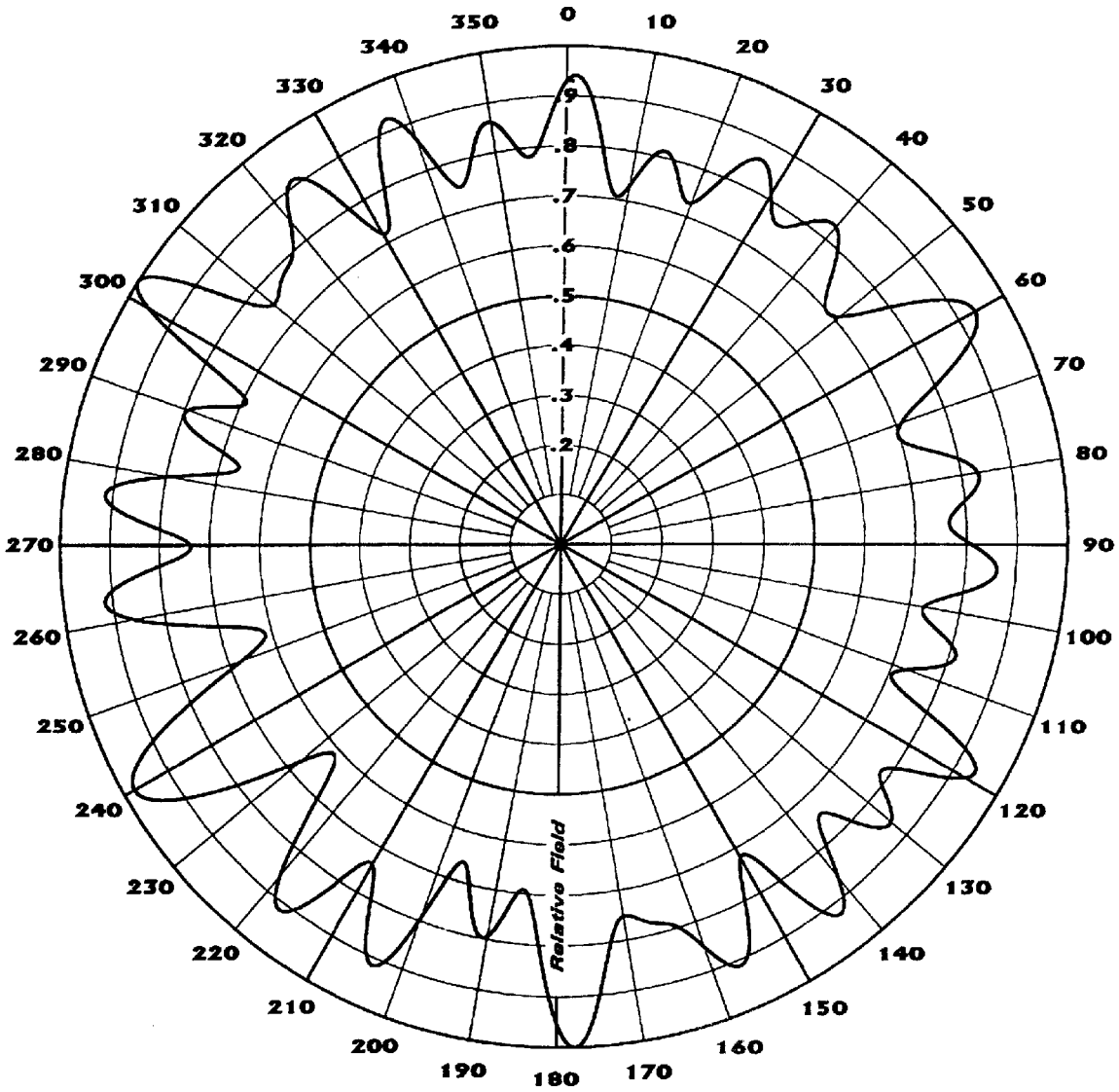
FIG. 7 is an azimuth pattern for the lower antenna of the structure of FIG. 6.

In accordance with a feature of the invention, at least one of the uprights 64, 66 and 68, and in the embodiments shown in FIG. 6, the upright 68, comprises an elongate antenna, such that this member is also designated by reference numeral 124. In the illustrated embodiment, the antenna 124 is also a travelling wave-type antenna comprising generally elongated cylindrical tubular pipe-like member from 40 to 60 feet in length and from 8 to 10 inches in diameter having a longitudinally arrayed series of slots therethrough spaced apart by approximately one wavelength of the center frequency of the channel to be transmitted thereby. The uprights 64 and 66 may be on the order of 6 inches in diameter. In the embodiment illustrated in FIGS. 6 and 7, the antenna 124 thus forms a structural element of the tower 62, and is designated for transmitting UHF channel 35, and has an 8.6 inch diameter. The distances between the respective structural upright members 64, 66 and 68 (which define an equilateral triangle cross-sectional area), designated by the letter L in FIG. 6, may be from 70 to 90 inches, with a 90 inch spacing being selected in the example given in FIG. 7. In this regard, FIG. 7 is the azimuth pattern for the channel 35 antenna 124 with the 90 inch spacing (L) and with the other uprights 64 and 66 being 6.2 inch diameter members. The antenna 124 could also be for a VHF channel in which case its diameter would be from about 16 inches to about 18 inches. Even less degradation than shown in FIG. 7 may be expected for a VHF antenna, due to its larger diameter relative the approximate 6 inch diameter of the other uprights 64 and 66. Generally speaking, TV broadcast channels in the VHF spectrum are assigned frequencies from about 174 MHz to about 213 MHz, while the UHF channels are assigned frequencies from about 470 MHz to 806 MHz.

Figure 3:
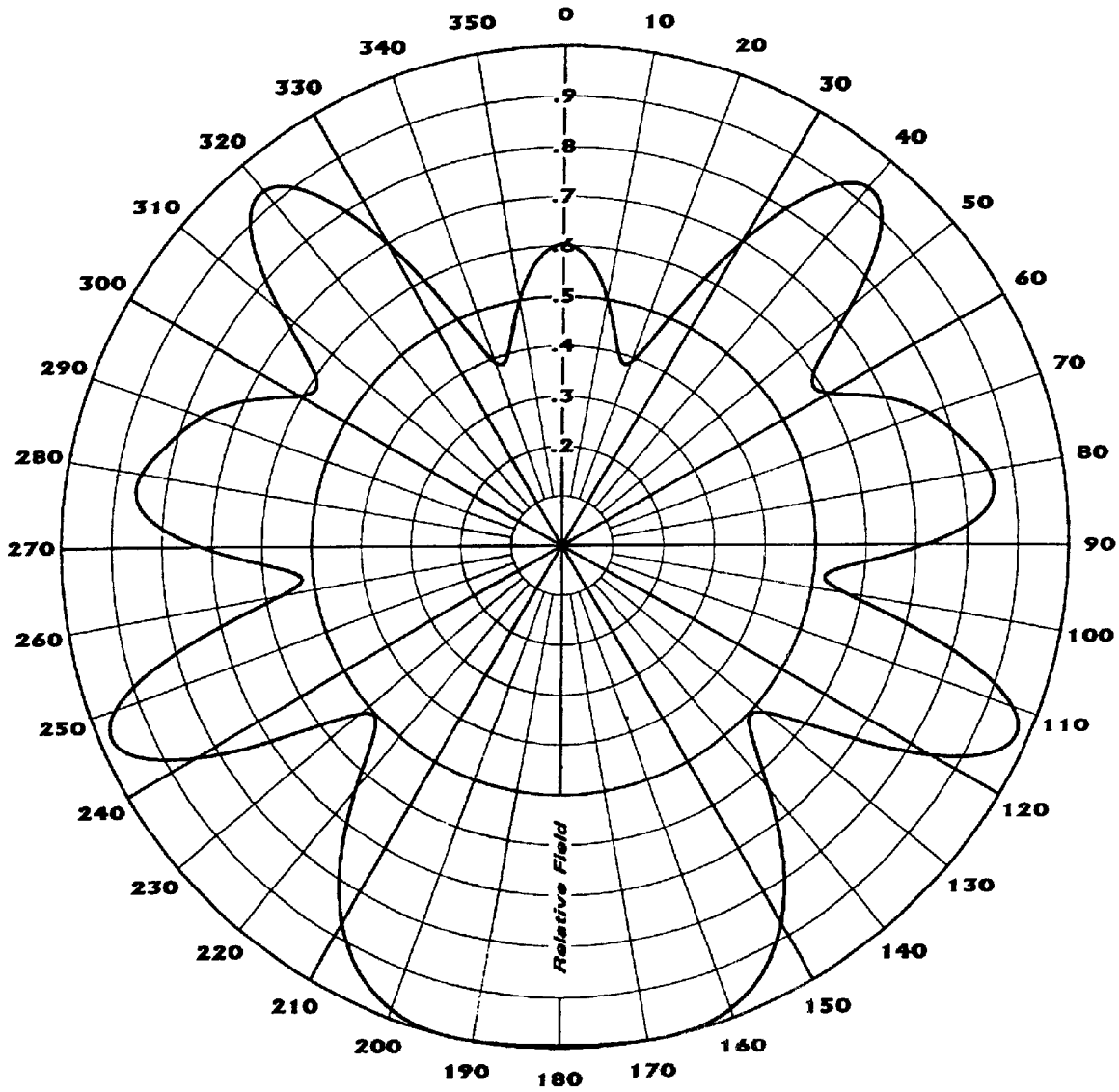
FIG. 3 PRIOR ART
FIG. 3 is another azimuth pattern for the offset antenna of the system of FIG. 1, with different spacing from the pylon.

Referring briefly to FIG. 7, the azimuth pattern for the antenna 124 will be seen to suffer substantially less degradation than those of FIGS. 2, 3 and 5 as discussed hereinabove, for the respective offset stack and centerfed stack configurations of the prior art. The 0° azimuth is taken in the direction of the upright member or leg 64 in the structure of FIG. 6.

Figure 8:
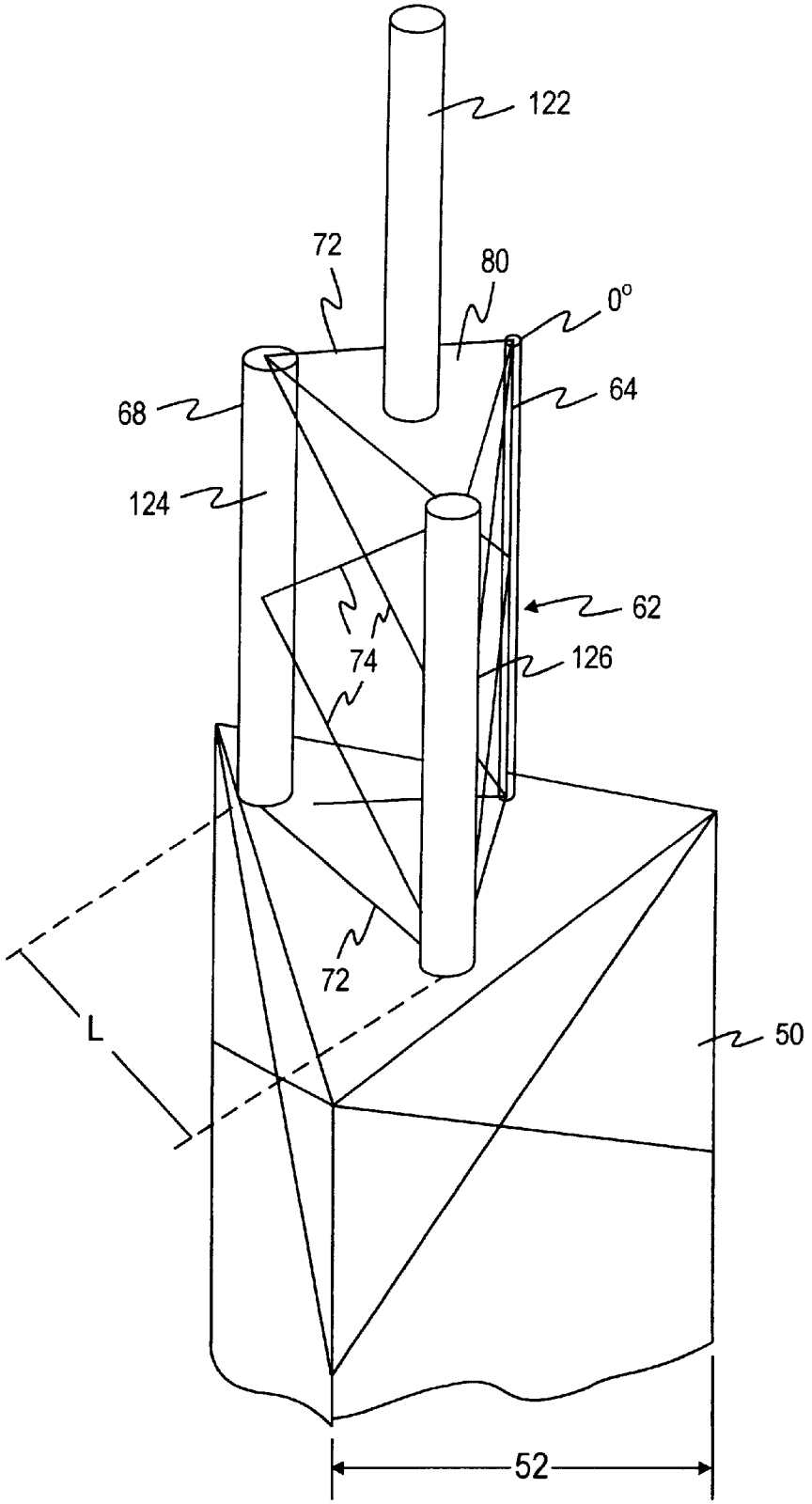
FIG. 8 is a somewhat simplified showing of a second form of stacked antenna system in accordance with the invention.

Referring now to FIG. 8, a second form of antenna and tower structure in accordance with the invention is illustrated. Like parts and components of the structure of FIG. 8 are designated by the same reference numerals used to designate these components in the embodiment of FIG. 6. However, in FIG. 8, a second structural upright member or leg of the tower portion 62 is also an antenna of substantially the same type of antenna 124, and is designated in FIG. 8 by the reference numeral 126. While travelling wave-type antennas are described herein, the invention may be practiced with other types of elongated antennas capable of being used as structural members, in the case of the antennas 124 and 126. Moreover, the top antenna 122 may be of any type or design, a travelling wave-antenna having been described above only by way of giving a specific example.

Figure 9:
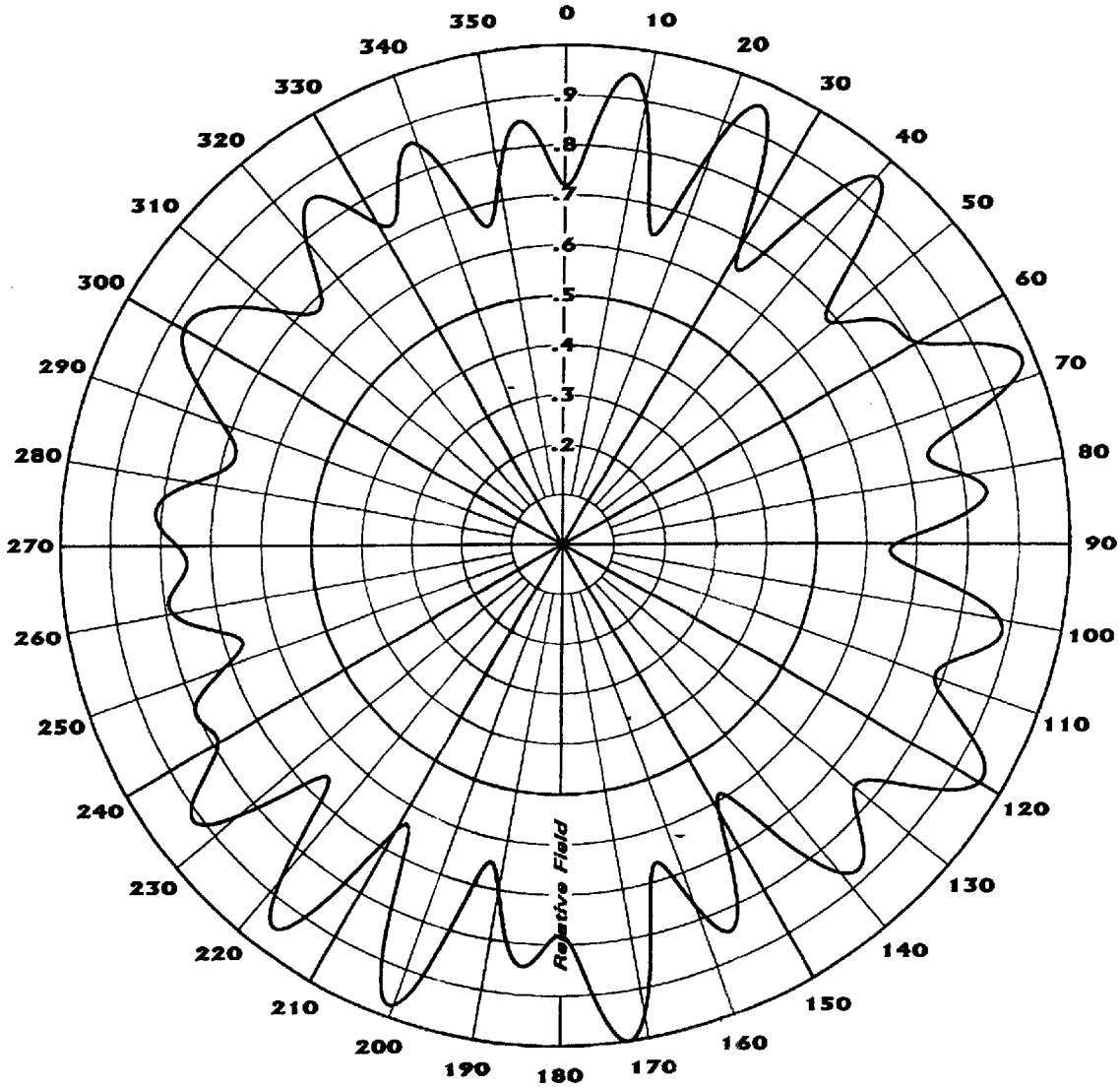
FIG. 9 is an azimuth pattern for one of the lower antennas of the structure of FIG. 8.
Figure 10:
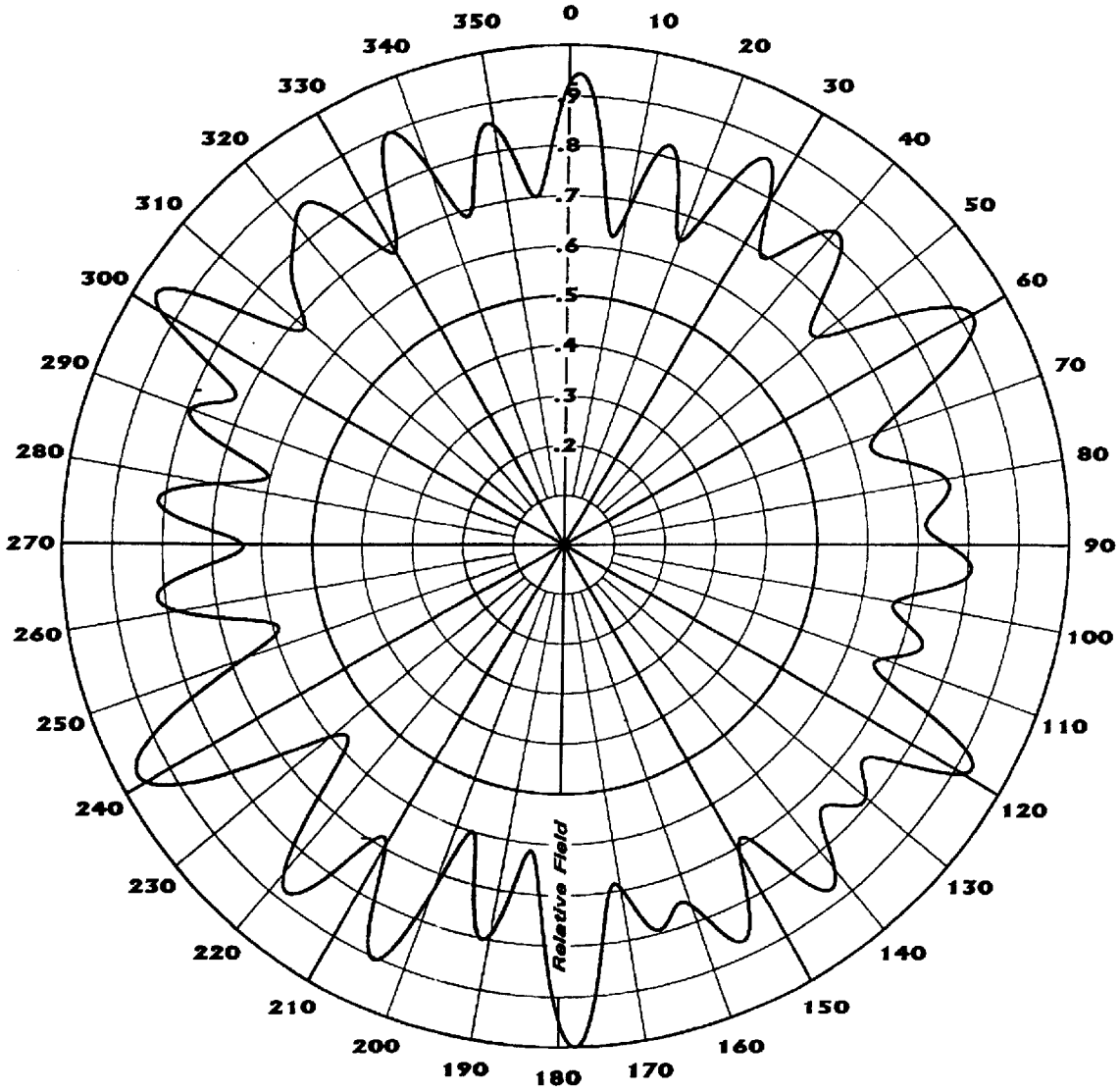
FIG. 10 is an azimuth pattern for the other of the lower antennas of the structure of FIG. 8.

FIG. 9 shows the azimuth pattern for the antenna 126 and FIG. 10 shows the azimuth pattern for the antenna 124. In the examples of azimuth patterns shown in FIGS. 9 and 10, the antenna 124 is configured for broadcasting UHF channel 35 while the antenna 126 is configured for broadcasting UHF channel 20, and the spacing L is 90 inches. Both of these antenna elements are approximately 8.6 inch diameter travelling wave-type antennas or slotted pipes as described above. The remaining upright leg or support member 64 is a 6.2 inch diameter cylindrical member. The 0° azimuth direction is also taken in the direction of the upright 64. In both FIGS. 6 and 8, the top antenna 122 is mounted substantially centrally with respect to the cross-sectional configuration defined by the tower support structure 62. A suitable plate 80 or other appropriate structural elements may support the top antenna 122.

Figure 11:
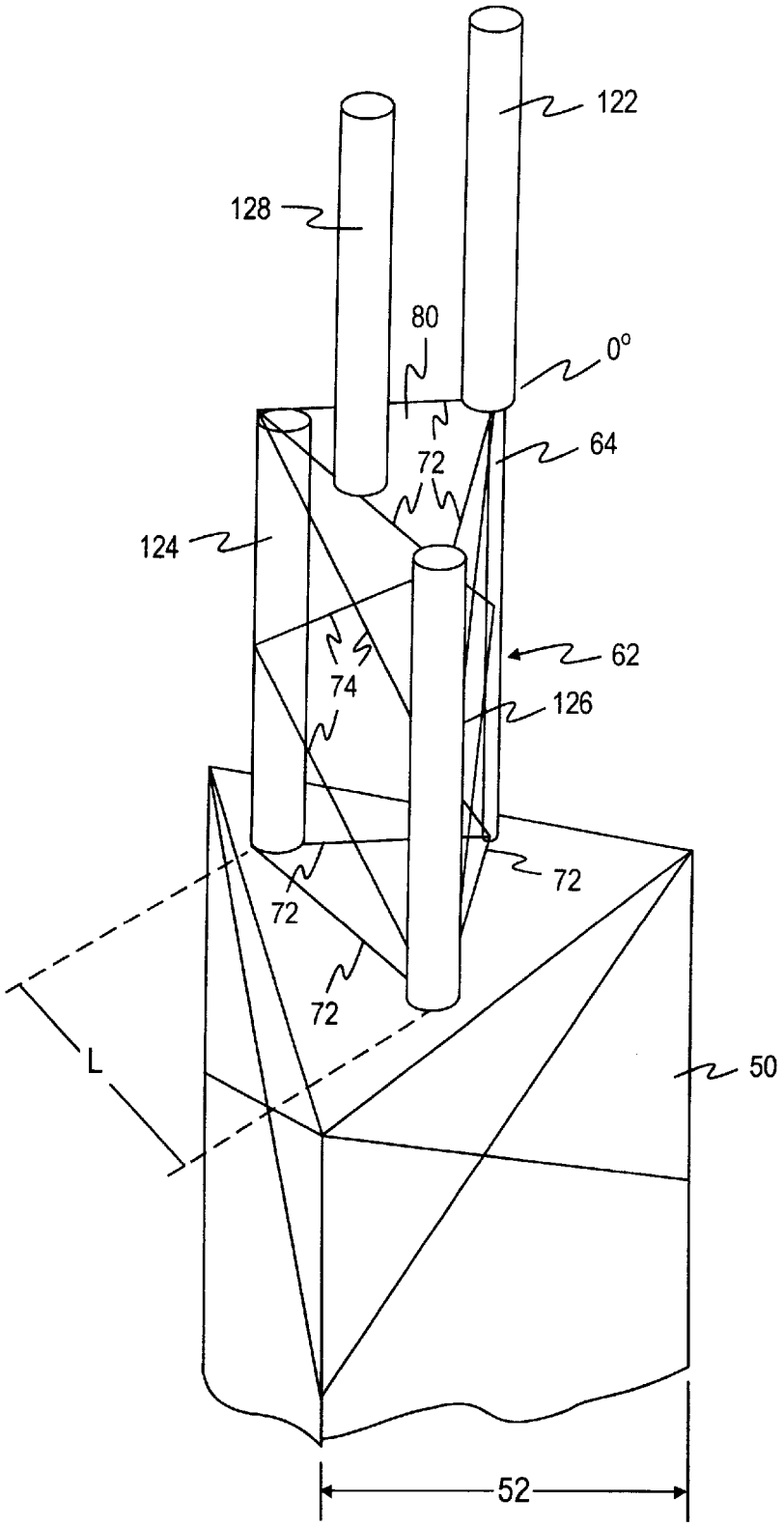
FIG. 11 is a simplified showing of yet another form of stacked antenna structure in accordance with the invention.

Referring next to FIG. 11, the structure shown is substantially identical to the structure shown and described above with reference to FIG. 8, with the exception of the use of two top-mount antennas 122 and 128, which are in somewhat different locations from the top-mounted antenna 122 of FIGS. 6 and 8. In all other respects, like reference numerals are used to designate like parts of the structure of FIG. 11 to that shown and described above with reference to FIGS. 6 and 8. In FIG. 11, the spacing L between the upright elements of the tower support structure may be from 70 to 90 inches generally speaking. This distance, in each of FIGS. 6, 8 and 11, may be somewhat less or somewhat greater than these dimensions, depending upon the specific application, channel selection, number of antennas and other structural features of the stacked antenna of the invention, as may be selected for a given use or application.

Returning to FIG. 11, the second top-mounted antenna 128 is also provided extending from the top surface portion of the support structure 62, such as a support plate 80 or the like. In the embodiment shown in FIG. 11, the top-mount antenna 122 is mounted approximately directly above or coaxially with the upright member 64, while the second top-mount antenna 128 is mounted at a point or in an area substantially midway between the two lower antenna members 124 and 126. While the illustrated embodiments show one or more top-mounted antennas in the form of travelling wave-type antennas, other tower top arrangements may be employed within the scope of the invention. No antenna at all, or other equipment could be mounted atop the plates or platforms 80. Also, the top-mounted antenna(s) could comprise any other type of antenna(s) desired, omnidirectional, or directional, of any type or design.

Figure 12:
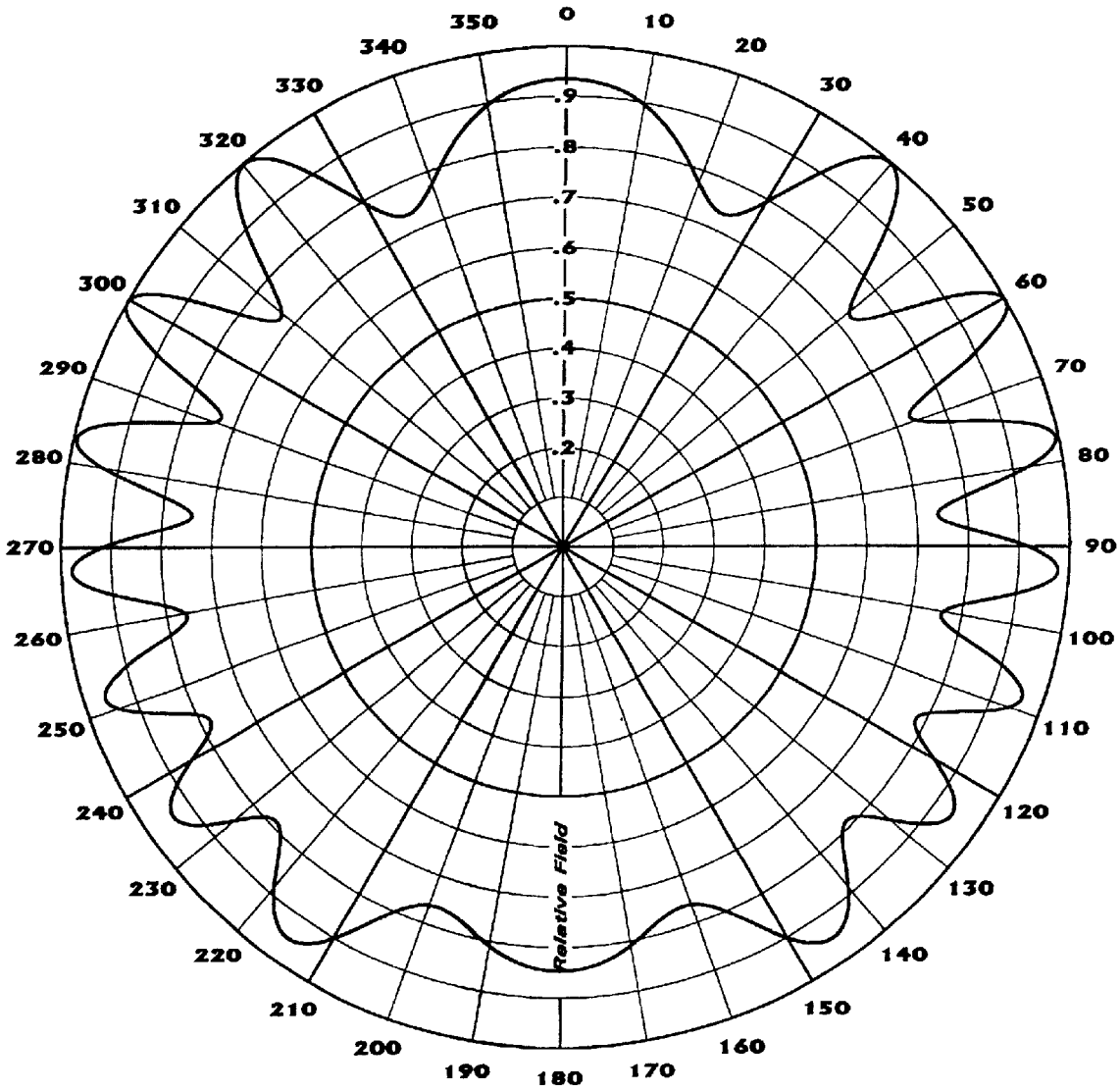
FIG. 12 is an azimuth pattern for one of the upper antennas of the structure of FIG. 11.
Figure 13:
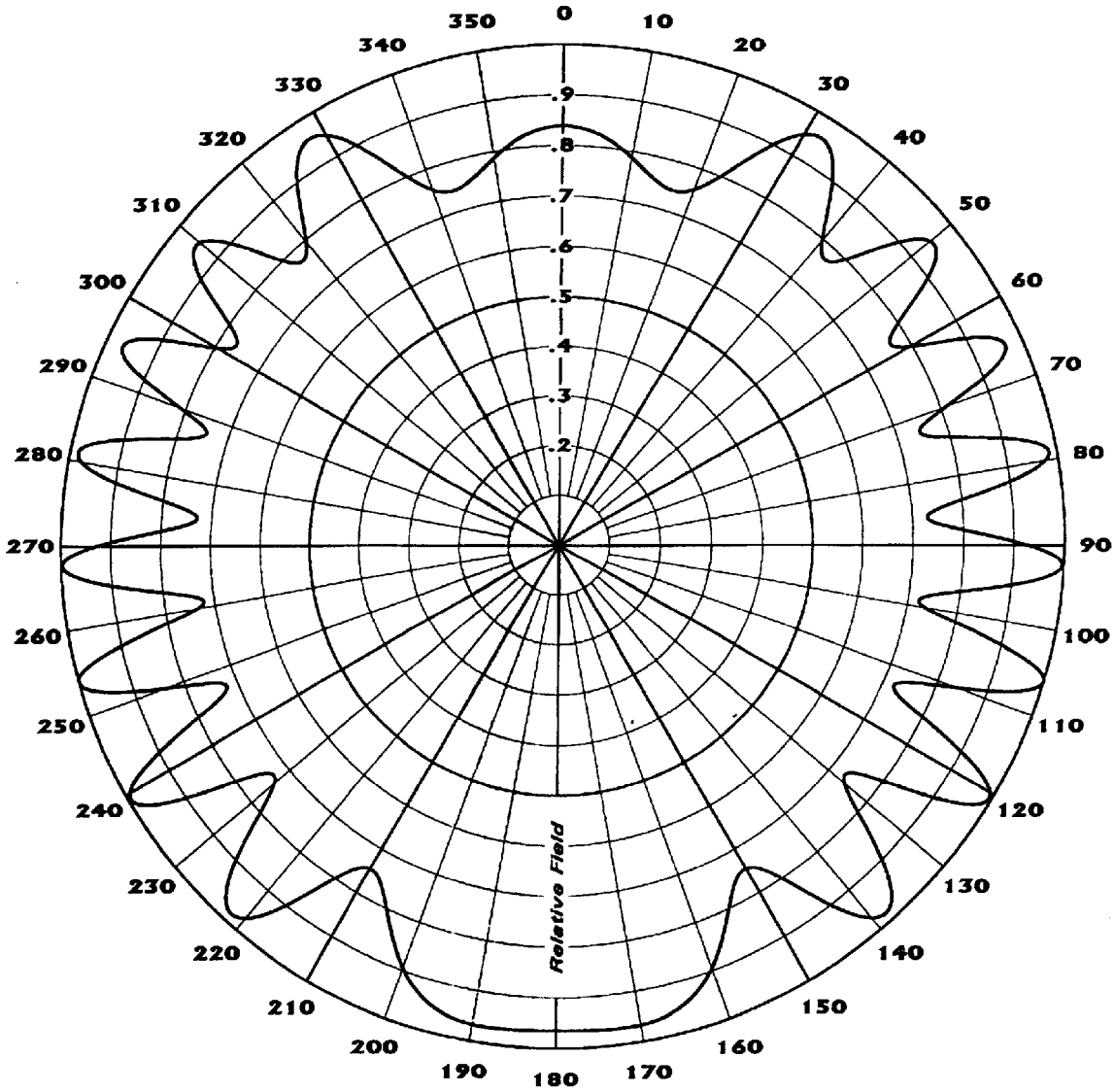
FIG. 13 is an azimuth pattern for the other of the upper antennas of the structure of FIG. 11.

The azimuth pattern of FIG. 12 is for the antenna 122 being used for UHF channel 20 and with the spacing L of 84 inches. The azimuth pattern of FIG. 13 is for the antenna 128 being used to transmit UHF channel 35 and with the spacing L of 84 inches.

It will be noted that in each instance in FIGS. 6, 8 and 11, the triangular configuration defined by the tower 62 is equilateral such that the distance L is substantially the same as between each pair of the upright members 64, 66, 68 used to construct the tower structure 62. In each of the embodiments of the invention described above, any of the described antennas may also be an antenna for a different UHF or VHF channel, or of a different antenna type, without departing from the invention. Also, each of the antennas may be either end fed or centerfed. Moreover, the structure may be modified in the field to add or change antennas, for example, substitute or add an antenna for a different or additional UHF or VHF channel.

While the embodiments of the invention have been described with reference to the use of omnidirectional antennas, antennas with directional characteristics could also be utilized. Such antennas could have the same structure as described but with the longitudinal arrays of slots being at fewer than all four of the 90 degree intervals about the perimeters of the tubes or pipes which form the antennas. A similar minimal amount of signal degradation for such antennas having directional characteristics may also be expected in accordance with the principals of the invention. While antennas for UHF channels are described above, the invention could also be used for VHF channel antennas. However VHF channel antennas of similar design are usually on the order of from 16 inches to 18 inches in diameter.

Summarizing the above, in the azimuth patterns from the offset stack (FIG. 1) and the centerfed stack (FIG. 4) where the feeder passes through the antenna aperture (FIGS. 2, 3 and 5), the reason for the degrading of signal strength are the multiple reflections (scattering) caused by the close proximity of the supporting structure 20 or the reflections caused by the feeder 28.

In the stacked approach of the invention, the antenna is part of the supporting structure so that the amount of scattering is minimized, lower because the leg size of the structure is small and the distance from the antenna is greater than that of the offset stack (FIG. 1). The structure size (face) L is determined to give the best azimuth coverage (i.e., the minimum amount of signal degradation).

By incorporating the antenna into the structure (see FIGS. 6 and 8), the ability to get more than one omnidirectional coverage antenna on a single tower structure is possible. Moreover, the structure may be modified in the field to add or change antennas, for example, substitute or add an antenna for a different or additional UHF or VHF channel. By placing up to two antennas on the upper portion of the structure and up to two antennas in the two legs of the structure, a total of up to eight channels is possible using current adjacent channel technology. The optimizing of the channel(s) to the structure size optimizes the coverage.

In the invention described above, the stacked (lower) antenna is actually part of a tower structure. This tower structure usually has about a 20 inch to 90-inch "face" dimension L. The antenna patterns can be directional or omnidirectional. There is some coverage degradation from the structure, but this is usually manageable. The upper antenna feeder may be run up the adjacent "non-antenna" leg or upright as described above. This configuration also allows for two top-mount antennas as in FIG. 11.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An antenna/tower structure mountable to a tower top or building top, comprising:

an elongated tower having a polygonal cross-sectional configuration and constructed having at least three spaced apart upright members defining said cross-sectional configuration and a plurality of cross members interconnecting said upright members;

at least one of said upright members of said elongated tower comprising an elongated antenna; and at least one top-mounted antenna comprising an elongated antenna mounted to and extending from a top end of said elongated tower.

2. The structure of claim 1 wherein said top-mounted antenna is generally centered with respect to said polygonal cross-sectional configuration of said elongated tower.

3. The structure of claim 1 wherein two of said upright members comprise elongated antennas.

4. The structure of claim 3 Wherein the diameter of each said upright member comprising an antenna is greater than the cross-sectional dimension of each upright member not comprising an antenna.

5. The structure of claim 3 wherein each of said antennas comprises a travelling wave-type antenna.

6. The structure of claim 1 wherein the diameter of each said upright member comprising an antenna is greater than the cross-sectional dimension of each upright member not comprising an antenna.

7. The structure of claim 1 wherein two top-mounted antennas extend from said top end of said elongated tower, each comprising an elongated antenna.

8. The structure of claim 7 wherein a first of said two top-mounted antennas extends generally coaxially from one of said upright members which does not comprise an antenna and wherein the other of said two top-mounted antennas extends from an area substantially midway between the other two upright members.

9. The structure of claim 7 wherein two of said upright members comprise elongated antennas.

10. The structure of claim 9 wherein the diameter of each said upright member comprising an antenna is greater than the cross-sectional dimension of each upright member not comprising an antenna.

11. The structure of claim 9 wherein each of said antennas comprises a travelling wave-type antenna.

12. The structure of claim 7 wherein each of said antennas comprises a travelling wave-type antenna.

13. The structure of claim 1 wherein the diameter of each said upright member comprising an antenna is greater than the cross-sectional dimension of each upright member not comprising an antenna.

14. The structure of claim 1 wherein said polygonal cross-sectional configuration comprises an equilateral triangle.

15. The structure of claim 14 wherein the center-to-center spacing between the respective upright members is from on the order of 70 inches to on the order of 90 inches.

16. The structure of claim 1 wherein said at least one upright member comprising an antenna further comprises an elongated slotted cylinder having a plurality of slots therethrough longitudinally spaced by substantially one wavelength of a center frequency of a channel to be transmitted by said antenna.

17. The structure of claim 1 wherein said at least one upright comprising an antenna has a diameter of from substantially 8 inches to substantially 10 inches and wherein each other upright member has a diameter of substantially on the order of 6 inches.

18. The structure of claim 1 and further including a feedline for said a top mounted antenna, said feedline extending along one of said uprights other than the at least one upright comprising an antenna.

19. A method of constructing an antenna/tower structure mountable to a tower top or building top, comprising:

positioning at least three spaced apart upright members to define an elongated tower having a ploygonal cross-sectional configuration;

interconnecting said upright members using a plurality of cross members;

utilizing at least one of said upright members of said elongated tower as an antenna; and mounting at least one additional antenna extending from a top end of said elongated tower.

20. The method of claim 19 including substantially centering said top-mounted antenna with respect to said polygonal cross-sectional configuration of said elongated tower.

21. The method of claim 19 including utilizing two of said upright members as antennas.

22. The method of claim 19 including constructing each said upright member comprising an antenna so as to have a diameter greater than the cross-sectional dimension of each upright member not comprising an antenna.

23. The method of claim 19 including mounting two additional antennas extending from said top end of said elongated tower.

24. The method of claim 23 including positioning a first of said two additional antennas to extend generally coaxially from one of said upright members which does not comprise an antenna and positioning the other of said additional antennas to extend from an area substantially midway between the other two upright members.

25. The method of claim 23 including utilizing two of said upright members as antennas.

26. The method of claim 19 including forming said at least one upright member utilized as an antenna as an elongated slotted cylinder having a plurality of slots therethrough longitudinally spaced by substantially one wavelength of a center frequency of a channel to be transmitted by said antenna.

27. The method of claim 19 and further including extending a feedline for said additional antenna along one of said uprights other than the at least one upright utilized as an antenna.

28. The method of claim 19 wherein each said antenna is a travelling wave-type antenna.

* * * * *